US007950337B2

(12) United States Patent
Chen

(10) Patent No.: US 7,950,337 B2
(45) Date of Patent: May 31, 2011

(54) FOLDABLE FRAME STRUCTURE FOR FOLDABLE TABLE OR BED

(76) Inventor: Te-Lung Chen, Tainan (TW)

( * ) Notice: Subject to any disclaimer, the term of this patent is extended or adjusted under 35 U.S.C. 154(b) by 0 days.

(21) Appl. No.: 12/074,311

(22) Filed: Mar. 4, 2008

(65) Prior Publication Data

US 2009/0283019 A1 Nov. 19, 2009

(51) Int. Cl.
*A47B 3/00* (2006.01)

(52) U.S. Cl. ..... 108/115; 108/34; 108/38

(58) Field of Classification Search ..... 108/115, 108/33, 34, 35, 36, 38
See application file for complete search history.

(56) References Cited

U.S. PATENT DOCUMENTS 633,203 A * 9/1899 O'Buckley ..... 108/36
734,645 A * 7/1903 Makinen ..... 108/34
777,186 A * 12/1904 Dittmar ..... 108/36
1,063,642 A * 6/1913 Birdsall ..... 108/36
1,211,829 A * 1/1917 Eades ..... 108/35
1,305,809 A * 6/1919 Kieffer ..... 108/35
1,363,062 A * 12/1920 Steere ..... 108/34
1,781,562 A * 11/1930 Wallis ..... 108/35
2,652,300 A * 9/1953 Graber et al. ..... 108/34
2,743,979 A * 5/1956 Shore ..... 108/35
2,903,313 A * 9/1959 Block ..... 108/35
2,969,603 A * 1/1961 O'Buckley ..... 108/34
3,005,670 A * 10/1961 Schultz ..... 108/35
3,208,807 A * 9/1965 Becker ..... 108/35
3,873,114 A * 3/1975 Brown ..... 312/237

* cited by examiner

*Primary Examiner* — José V Chen

(57) ABSTRACT

A foldable frame structure of the foldable table or bed comprises main frames, secondary frames, L-shaped folding hinges and connecting members. An adjacent side of each main frame and the secondary frame is formed a foldable joint which is connected by the connecting members and the L-shaped folding hinges. The size of the secondary frames is smaller than the main frames, wherein each of the secondary frames is able to be folded in the main frames.

4 Claims, 8 Drawing Sheets

FOLDABLE FRAME STRUCTURE FOR FOLDABLE TABLE OR BED

BACKGROUND OF THE PRESENT INVENTION

1. Field of the Invention

The present invention relates to a foldable frame structure for foldable table or bed, wherein particularly comprises a foldable main frame and secondary frames connected by connecting members and L-shaped folding hinges capable of being respectively folded into main frames of the foldable bed or table top.

2. Description of Related Invention

As Shown in FIG. 7 and FIG. 8, a conventional foldable frame structure relates to two conventional foldable frames which connected each adjacent side by the hinges. When the structure are being folded, a conventional foldable frame being folded pivotally through the hinges on the top of another in order to make the frame structure pile up from the flat panels. However, it is still not capable of reducing its overall size and the core problems regarding bulky and inconvenient cannot be resolved.

SUMMARY OF THE PRESENT INVENTION

The present invention relates to a foldable frame structure of the foldable table or bed which comprises main frames, secondary frames, L-shaped folding hinges and connecting members.

The invention has the following advantage:

The size of the secondary frames is smaller than the main frames, therefore, the secondary frames are folded respectively in the main frames. This will be capable of reducing its overall size and the core problems regarding bulky.

DETAILED DESCRIPTION OF THE PREFERRED EMBODIMENT

Referring to FIG. 1 to FIG. 6 of the drawings, a foldable frame structure of a foldable table or bed according to a preferred embodiment of the present invention is illustrated. The frame structure mainly comprises main frames (10), secondary frames (20), L-shaped folding hinges (30) and connecting members (40). Wherein the inner edge on the adjacent side of the main frames (10) and secondary frames (20) which are respectively installed with the connecting members (40). The size of the secondary frames (20) is smaller than the main frames (10) in size. The L-shaped folding hinges (30) are mounted and pivotally connected between the connecting members (40) of the main frames (10) and the connecting members (40) of the secondary frames (20).

The connecting members (40) installed respectively on the main frames (10) and secondary frames (20) are connected with both ends of the L-shaped folding hinges (30) for being adapted respectively the L-shaped folding hinges (30) and the joints on the connecting members (40) on the main frames (10) and the joints of the connecting members (40) on the secondary frames (20) as folding joints to pivotally two-staged fold and unfold.

Figure 1:
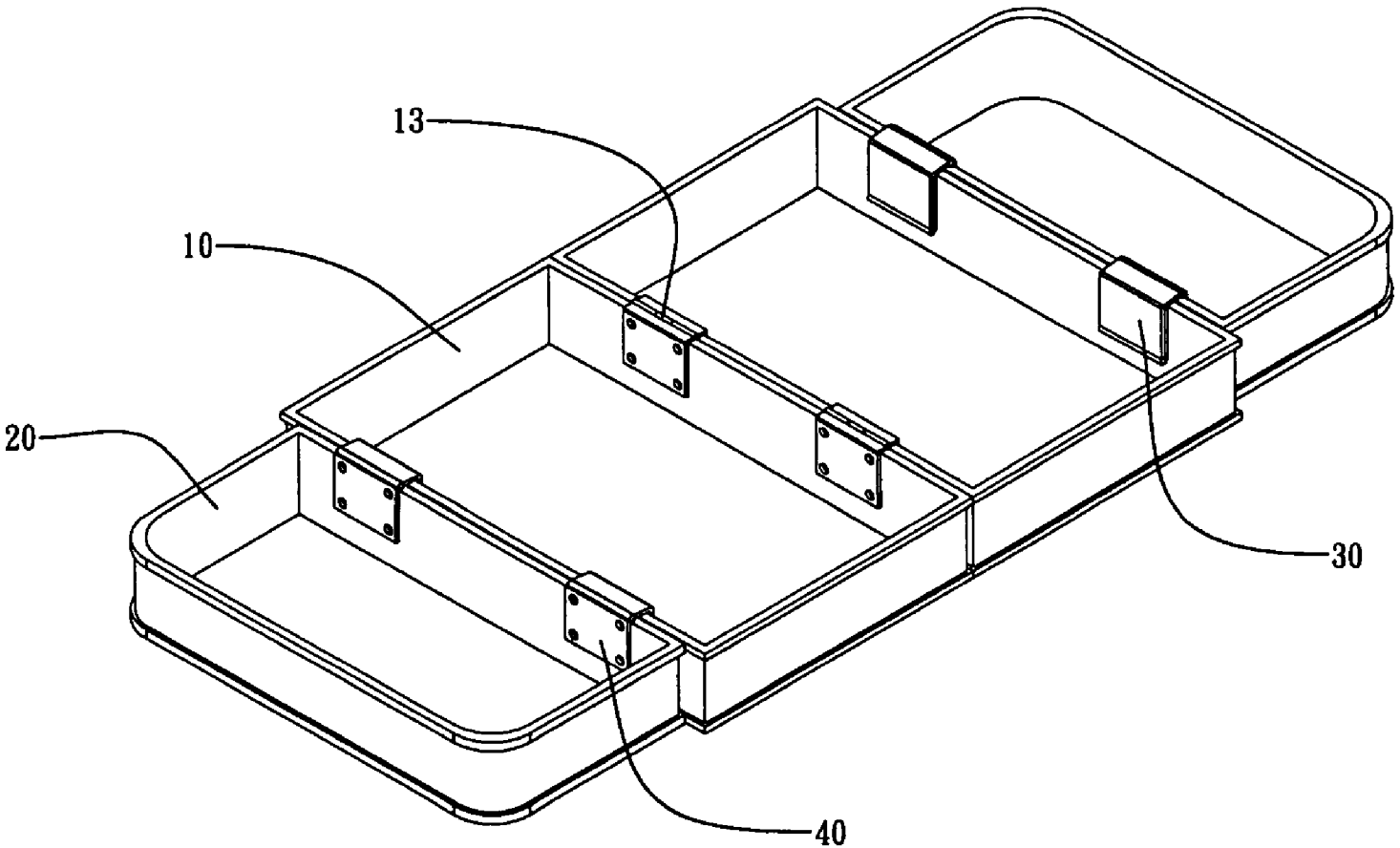
FIG. 1 is perspective view of a preferred embodiment of the present invention in unfolded position.
Figure 2:
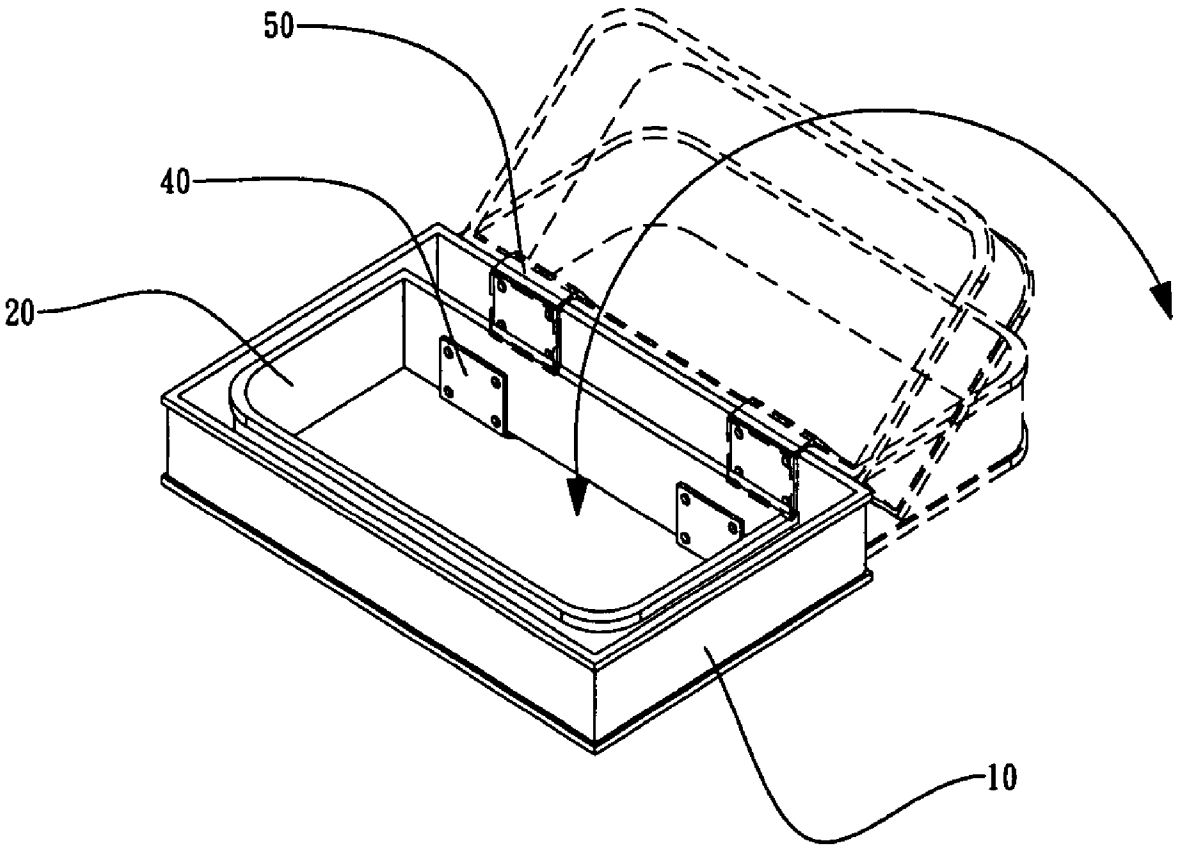
FIG. 2 is a schematic diagram of a preferred embodiment of the present invention, illustrating that the foldable frame structure being folded in folded position.
Figure 3:
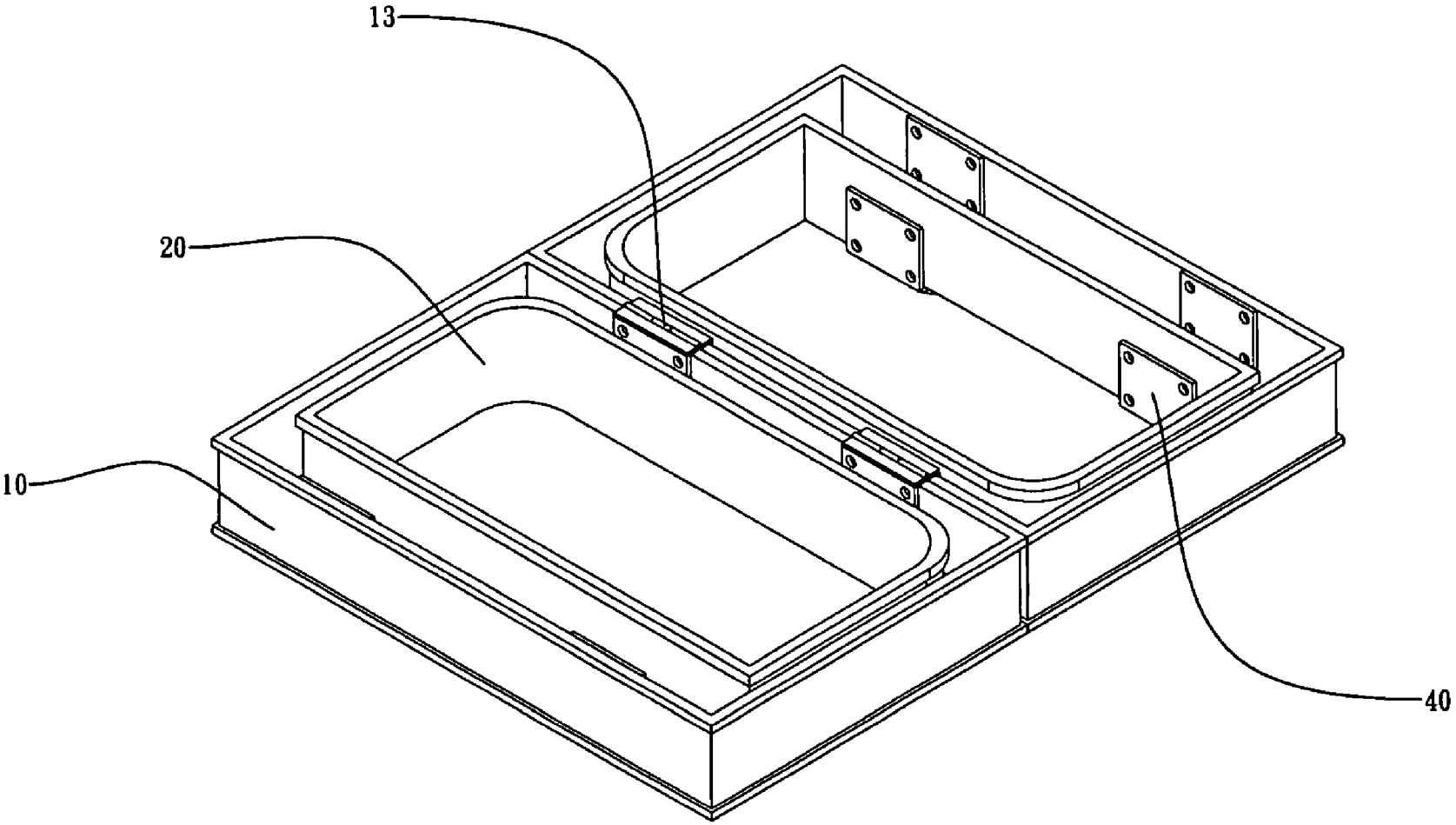
FIG. 3 is a schematic diagram of a preferred embodiment of the present invention, illustrating that the foldable frame structure being folded in folded position.
Figure 4:
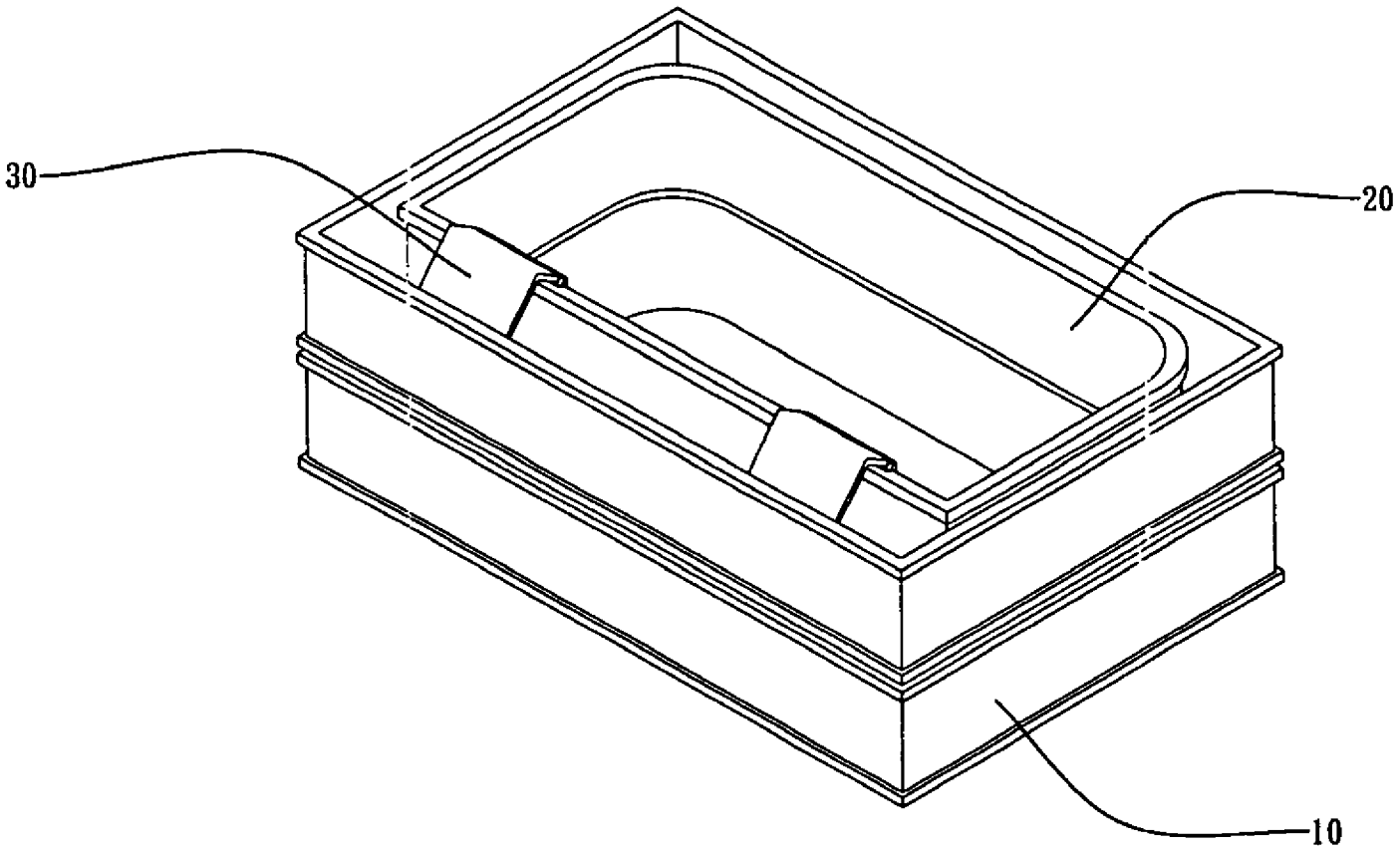
FIG. 4 is a schematic diagram of a preferred embodiment of the present invention, illustrating that the foldable frame structure being folded in another folded position.

As shown in FIG. 3, the adjacent side on the main frames (10) are connected with the hinges (13) which enable the two main frames (10) being rotated pivotally through the hinges.

The steps of the frame structure being folded are as follows. First, rotate the secondary frames (20) with the joints of the L-shaped folding hinges (30) and the connecting member (40) on the secondary frames (20) as a pivot to the proper angel, then rotate and press the secondary frames (20) into the main frames (10) with the joints of the L-shaped folding hinges (30) and the connecting member (40) on the main frames (10) as a pivot. This will enable the secondary frame (20) being folded into the main frame (10). Finally, rotate and lean the two main frames (10) each other with the hinges (13) as a pivot. Therefore, the overall size of the frame structure becomes only the size of the main frames (10) left and the core purpose of resolving the problem of bulky and inconvenient is then accomplished.

Figure 5:
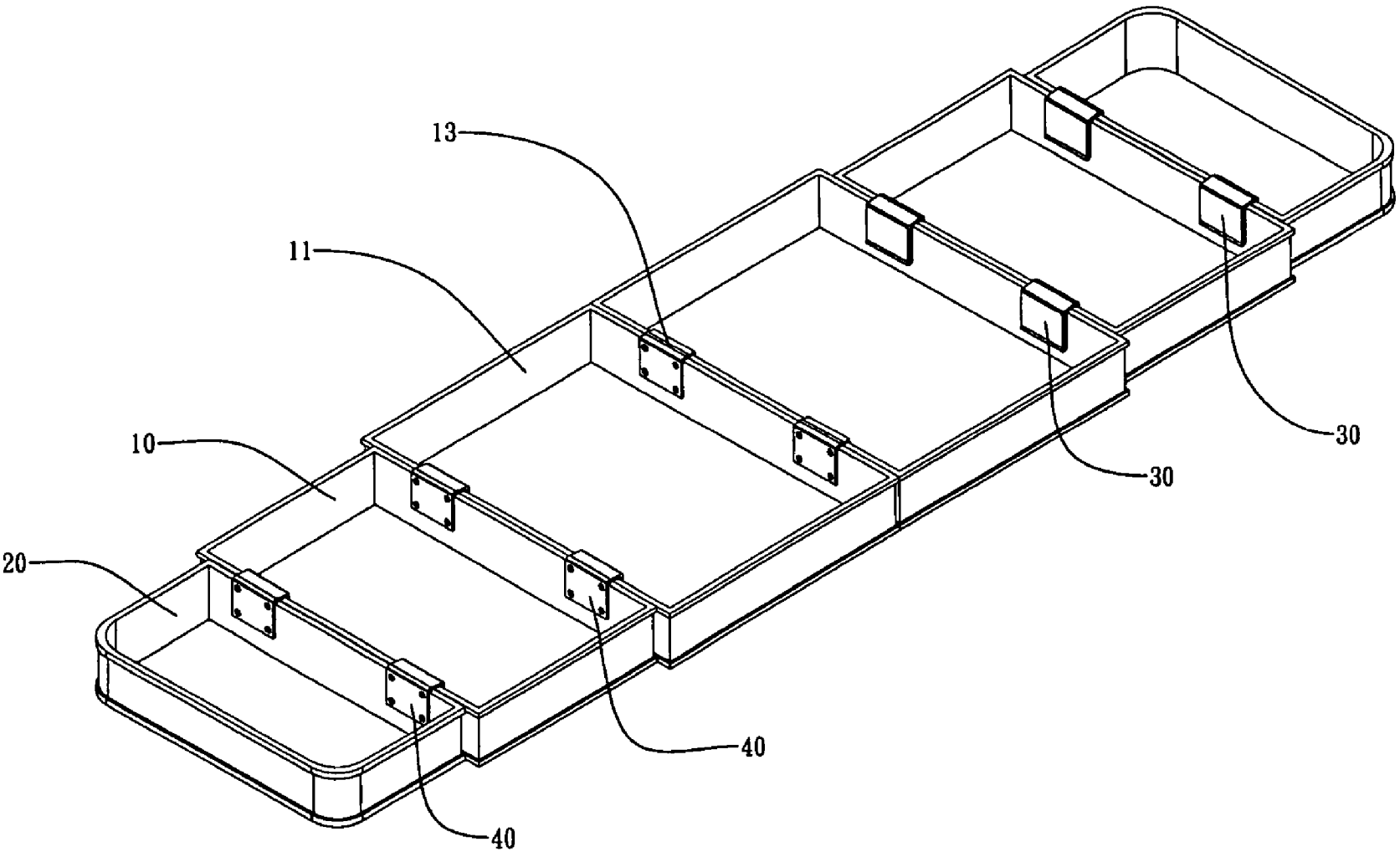
FIG. 5 is a schematic diagram of a preferred embodiment of the present invention, illustrating that the foldable frame structure being unfolded in unfolded position.
Figure 6:
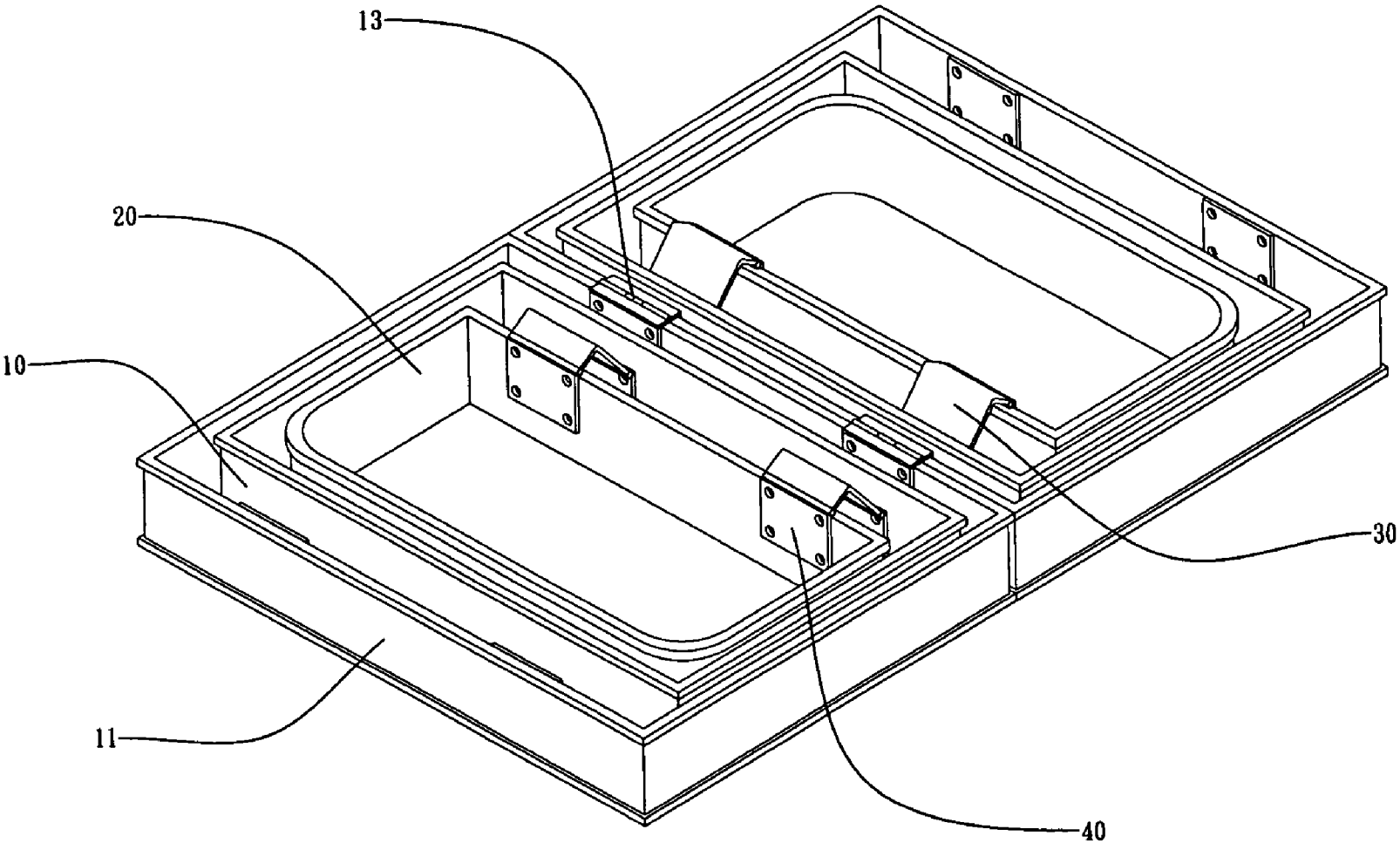
FIG. 6 is a schematic diagram of a preferred embodiment of the present invention, illustrating the folding position of the foldable frame structure.
Figure 7:
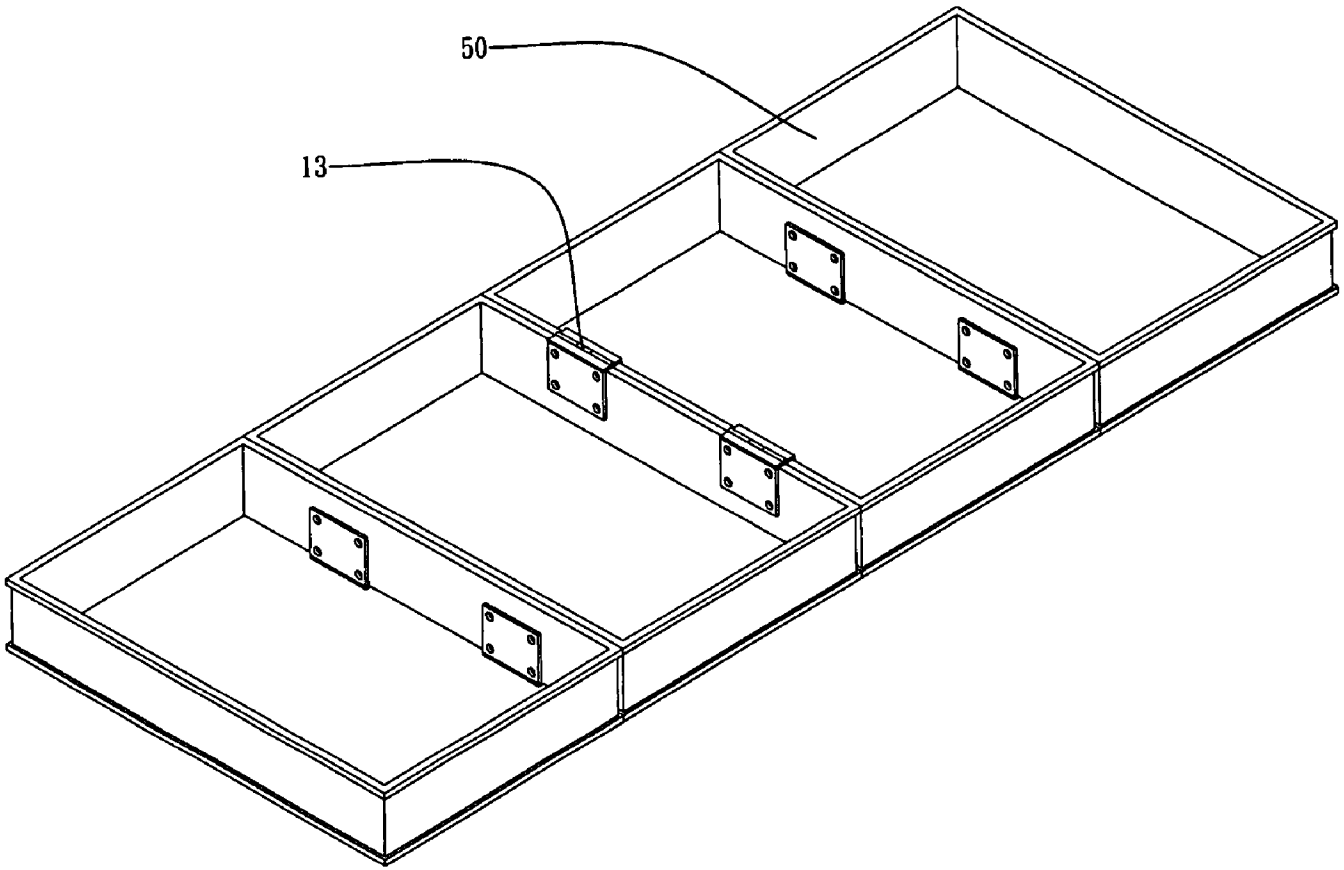
Fig. 7 Prior Art
FIG. 7 is a perspective view of the conventional invention in an unfolded position.
Figure 8:
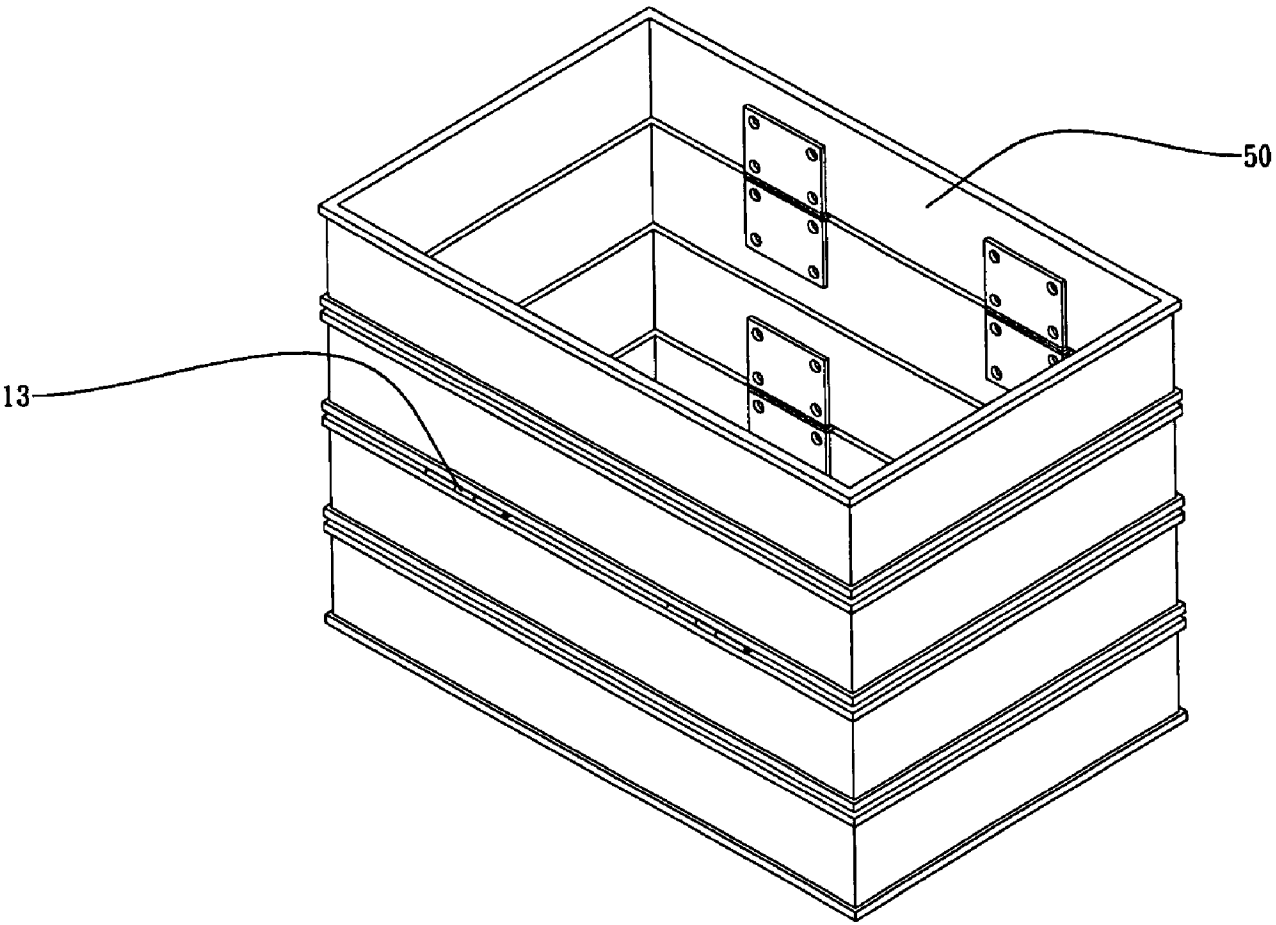
Fig. 8 Prior Art
FIG. 8 is a perspective view of the conventional invention in a folded position.

As shown in FIG. 5 and FIG. 6, the foldable frame structure comprises more than two sets of the main frames (10) and secondary frames (20) depending on the length. According to the principle above, bigger main frames (11) are added to the original main frames (10) for being adapted to lengthening the whole frame structure connected with the L-shaped folding hinges (30) and the connecting member (40). Each adjacent side on the bigger main frames (11) are connected with the hinges (13). When the frame structure is being folded, the bigger main frames (11) also have receiving cavities to completely receive the original main frames (10) and the secondary frames (20) are completely received by the main frames (10) respectively as well. The overall size of the frame structure becomes only the size of the bigger main frames (11) left. Therefore, this invention allows more and more sets of the main frames being added within the same spirit and procedure of the following claims.

What is claimed is:

1. A foldable frame structure for a foldable table or bed, comprising:

a main frame including a plurality of first frame sides, a first cavity defined by the first frame sides and at least one first connecting member secured to an inner surface of one of the first frame sides;

a secondary frame including a second frame side that is adjacent to the first frame side that has the first connecting member secured thereto and at least one second connecting member secured to an inner surface of the second frame side;

a first L-shaped folding hinge pivotally connecting the first and second connecting members such that the secondary frame is pivotable about an upper edge of the first frame side that has the first connecting member secured thereto, wherein the size of the secondary frame is smaller than the size of the main frame such that the entire secondary frame is receivable in the first cavity defined by the first frame sides, wherein the foldable frame structure is positioned between:

1) a folded position where the secondary frame is folded into the first cavity defined by the first frame sides such that the entire secondary frame is movably received within the first cavity, and 2) an unfoldable position where the secondary frame is aligned side by side with the main frame.

2. The foldable frame structure for a foldable table or bed of claim 1, further comprising a bigger main frame positioned adjacent to the main frame that is connected to the main frame by a second L-shaped folding hinge such that the length of the foldable frame structure is increased when the foldable frame structure is in an unfolded position, the bigger main frame defining a second cavity such that when the foldable frame structure is in a folded position, the main frame including the secondary frame folded therein is folded into the second cavity and completely received within the second cavity and the overall size of the foldable frame structure with the main frame and the secondary frame being folded in the bigger main frame equals the size of the bigger main frame.

3. The foldable frame structure for a foldable table or bed of claim 1, wherein the overall size of the foldable frame structure equals the size of the main frame when the foldable frame structure is positioned in the folded position.

4. The foldable frame structure for a foldable table or bed of claim 1, wherein the foldable frame structure includes two main frames and two secondary frames, each main frame having a connecting side, the connecting sides being connected to each other and positioned adjacent to each other, each secondary frame being connected to a side of the respective main frame that is opposing to the connecting side of the main frame by a first L-shaped folding hinge.

* * * * *